United States Patent [19]

Lachenmeier et al.

[11] Patent Number: 4,700,951

[45] Date of Patent: Oct. 20, 1987

[54] METHOD AND APPARATUS FOR PLAYING A GAME

[76] Inventors: Timothy T. Lachenmeier, 101 SW. Western Blvd., P.O. Box "O", Corvallis, Oreg. 97339; Christian S. Howard, 147 SE. Richland St., Corvallis, Oreg. 97333

[21] Appl. No.: 750,905

[22] Filed: Jul. 1, 1985

[51] Int. Cl.[4] ..... A63F 3/02; A63F 3/00

[52] U.S. Cl. ..... 273/264; 273/290

[58] Field of Search ..... 273/264, 271, 288, 290, 273/248, 249, 287, 242

[56] References Cited

U.S. PATENT DOCUMENTS

| | | | |
|---|---|---|---|
| 1,519,133 | 12/1924 | Hall | 273/249 |
| 3,099,451 | 7/1963 | Newhouse | 273/253 |
| 3,111,320 | 11/1963 | Acosta | 273/264 |
| 3,606,336 | 9/1971 | Krause | 273/272 |
| 3,761,093 | 9/1973 | Migliore | 273/288 |
| 3,885,791 | 5/1975 | Chouinard | 273/288 |
| 3,938,808 | 2/1976 | Bockmon | 273/288 |
| 4,138,120 | 2/1979 | Daitzman | 273/271 |
| 4,196,905 | 4/1980 | Yanari | 273/288 |
| 4,213,616 | 7/1980 | Dickey | 273/271 |
| 4,339,136 | 7/1982 | Gittings | 273/242 |
| 4,341,390 | 7/1982 | Hicks et al. | 273/288 |
| 4,391,448 | 7/1983 | Hermann, 3rd | 273/243 |
| 4,391,449 | 7/1983 | Johnson | 273/260 |
| 4,482,154 | 11/1984 | Mizunuma et al. | 273/153 S |
| 4,506,893 | 3/1985 | Perry | 273/258 |

FOREIGN PATENT DOCUMENTS

| | | | |
|---|---|---|---|
| 2013505 | 8/1979 | United Kingdom | 273/264 |

*Primary Examiner*—Richard C. Pinkham
*Assistant Examiner*—Benjamin Layno
*Attorney, Agent, or Firm*—Klarquist, Sparkman, Campbell, Leigh & Whinston

[57] ABSTRACT

A game and method of play are disclosed. The game consists of a playing field and at least two groups of playing markers, the groups being distinguishable from one another. Each playing marker has memory indicia thereon to mnemonically signify a continuous, sequential order by which the markers are moved. Players move their markers around the playing field one at a time, adhering to the order described above. A player cannot deviate from the specified order, and must move a marker with each turn. The object of the game is for one player to arrange his markers in a line on the playing field while preventing an opponent from doing so. Points are awarded when a player arranges his markers in a line.

6 Claims, 14 Drawing Figures

FIG. 1
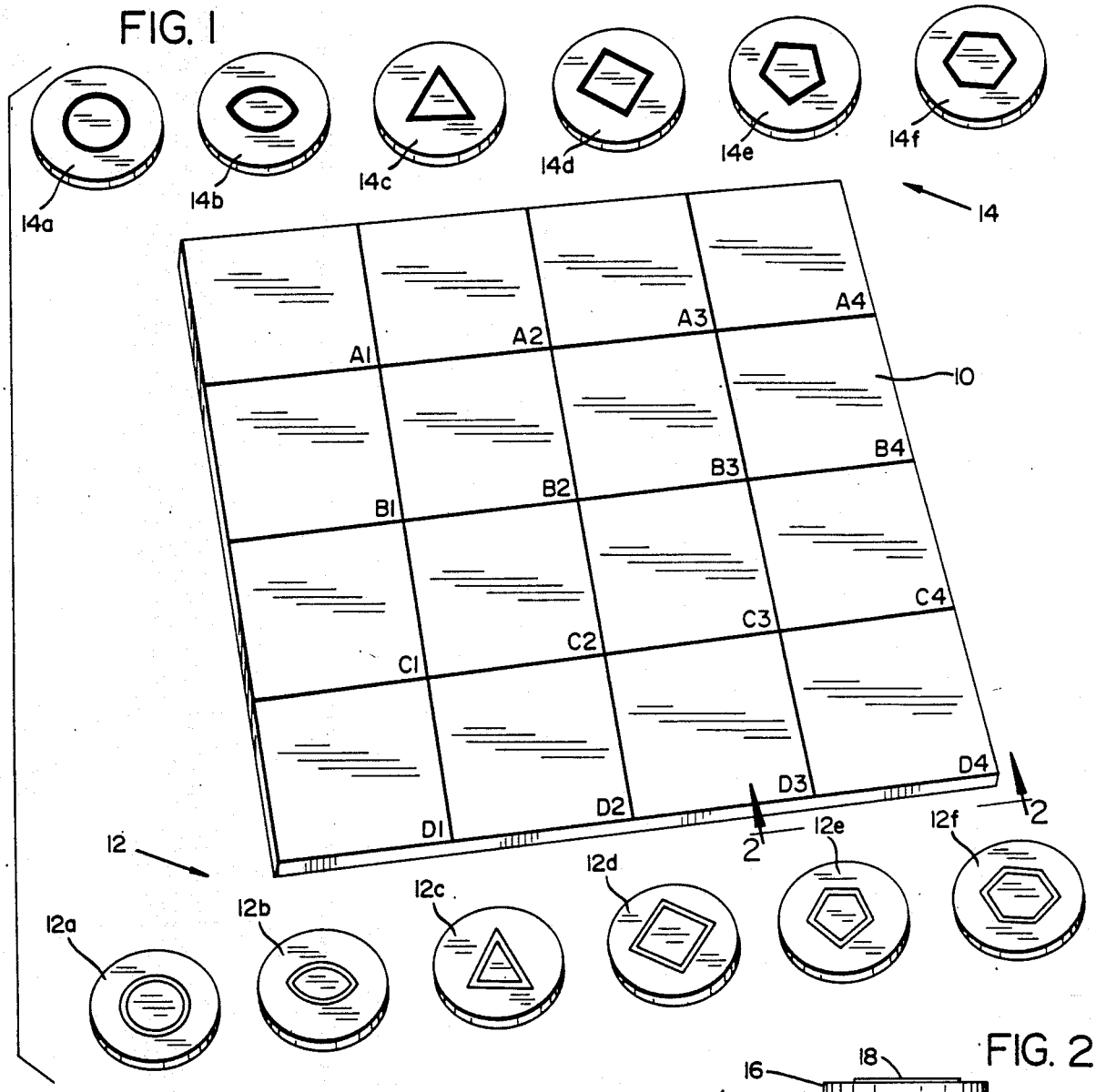
FIG. 2
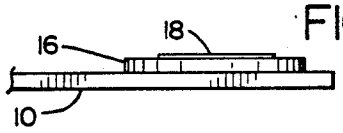
FIG. 3
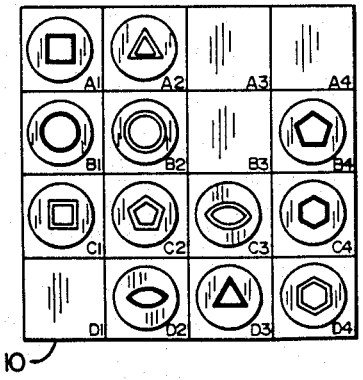
FIG. 4
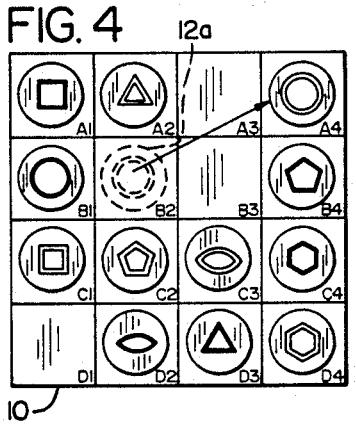
FIG. 13
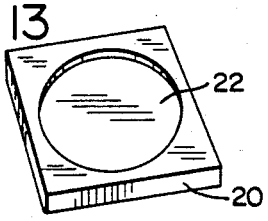
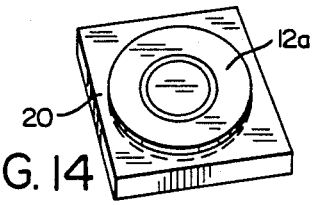
FIG. 14

METHOD AND APPARATUS FOR PLAYING A GAME

BACKGROUND OF THE INVENTION

The present invention relates to games and more particularly, to games involving a plurality of markers movable on a playing field in a continuous, sequential order in accordance with a specific set of rules.

The playing of parlor-type board games is a popular activity. Many of these games involve the selective movement of game pieces on a playing field divided into a plurality of zones.

For example, U.S. Pat. No. 4,339,136 to Gittings describes a board game having a plurality of triangular playing zones. The game uses two sets of multi-colored and multi-shaped markers, including one square marker per set. The markers are movable from one triangular zone to another in an attempt to block the movement of an opponent's square marker.

U.S. Pat. No. 4,138,120 to Daitzman describes a board game having four sets of playing markers, each set having four markers. In addition, each marker has two different physical characteristics. In one embodiment, these characteristics include shape (circle or triangle) and color (black or white). The object of the game is to arrange markers of predesignated shape and color in a horizontal, vertical, or diagonal line.

Other patents involving the arrangement of game pieces in a line on a playing field include U.S. Pat. No. 4,213,616 to Dickey and U.K. Pat. No. 2,013,505 to Holdway, et al. The Dickey patent describes a game board having 16 numbers arranged in four vertical and horizontal rows. The game also uses 16 cards corresponding to the numbers on the board. To play the game, the first player draws a card, noting the number thereon. A marker is then placed on any of the squares on the board having the selected number. The second player follows the same procedure. Play continues until one of the players has arranged his markers in a horizontal, vertical, or diagonal line on the board. The Holdway, et al. patent describes a game having a board with a plurality of spaces. Also provided are groups of markers, and a pack of cards, each card showing a particular arrangement of markers. Cards are drawn, and each player must move his markers on the board until the arrangement shown on his card is achieved.

Other patents involving games having markers movable on a playing field include U.S. Pat. Nos. 3,761,093 to Migliore; 3,885,791 to Chouinard; 3,885,792 to Breslow; 4,391,448 to Hermann III; 4,391,449 to Johnson; 4,482,154 to Mizunuma; and 4,506,893 to Perry.

The present invention involves a game having different rules and characteristics of play from those described above. Details of the game and its method of play are described in detail herein below.

SUMMARY OF THE INVENTION

It is an object of the present invention to provide a game which is easy and enjoyable to play.

It is another object of the present invention to provide a game which has rules of minimal complexity.

It is another object of the present invention to provide a game which is challenging and requires the development of competitive playing strategies.

It is another object of the present invention to provide a game having a minimal amount of components.

It is a further object of the present invention to provide a game having a competitive element whereby points are scored.

It is a feature of the present invention to provide a game in which a plurality of markers are movable on a playing field.

It is another object of the present invention to provide a game in which a plurality of markers are moved in a continuous, predetermined sequential order throughout the game.

These, together with other objects, features and advantages, which will become subsequently apparent, reside in the details of construction and operation as more fully herein described below, reference being had to the accompanying drawings forming a part hereof, wherein like numerals refer to like parts throughout.

BRIEF DESCRIPTION OF THE DRAWINGS

FIG. 1 is a perspective view of the playing field and two sets of playing markers.

FIG. 2 is a side elevational view of the playing field, taken along line 2—2 of FIG. 1, with a playing marker thereon showing movement indicia on the playing marker.

FIGS. 3–12 are top plan views of the playing field and playing markers showing a series of sample moves.

FIG. 13 is a perspective view of a scoring marker.

FIG. 14 is a perspective view of a scoring marker in combination with a playing marker.

DETAILED DESCRIPTION

Figure 5:
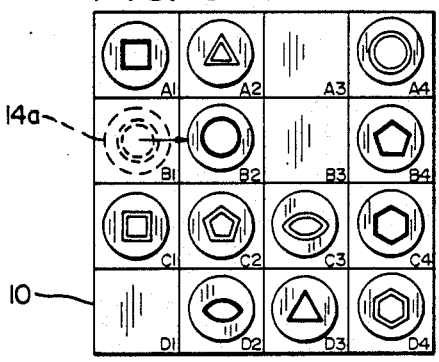

In a preferred form of the present invention shown in FIG. 1, a playing field 10 having 16 square playing zones of equal size is provided. The zones are arranged and labelled as shown in FIG. 1. Two groups of playing markers 12, 14 are provided, each group being distinguishable from the other. Various methods may be used to distinguish sets 12, 14 from each other, including differences in color, size, or other visual characteristics.

Each playing marker of each group has memory indicia thereon. The memory indicia mnemonically signify a continuous, sequential order by which the markers are moved throughout the game. The memory indicia of the embodiment described herein are as follows:

TABLE 1

| Group 12 - Playing Marker No.: | Group 14 - Playing Marker No.: | Memory Indicia | Order of Movement |
|---|---|---|---|
| 12a | 14a | Circle | 1 |
| 12b | 14b | Ovoid-Shape | 2 |
| 12c | 14c | Triangle | 3 |
| 12d | 14d | Square | 4 |
| 12e | 14e | Pentagon | 5 |
| 12f | 14f | Hexagon | 6 |

As shown in Table 1, the playing markers of each group are moved according to the memory indicia thereon in the following order: circle, ovoid-shape, triangle, square, pentagon, and hexagon. This order is based on an increasing number of "sides" with respect to the geometrical shape on each marker. For example, a circle is assumed to have one side and is moved first. The ovoid-shaped figure is assumed to have two sides and is moved second, and so forth.

The memory indicia signify a mnemonic natural progression allowing a player to remember the order in which his playing markers are moved. In addition, the order of movement defined by the memory indicia is "continuous." Specifically, after the last marker in a player's set is moved (hexagon), the next marker to be moved is the one bearing a circle. The sequence starts again, defining a continuous order.

It is also contemplated that other memory indicia may be used. These indicia must signify a mnemonic natural progression, and could include sequential numbers, alphabet letters, or other symbolic arrangements.

In addition, each playing marker of the present invention has movement indicia thereon. The movement indicia are designed to assist the players in determining which marker was last moved. For example, in the embodiment described herein, each of the markers has its geometric design embossed on only one side. FIG. 2 shows a playing marker 16 and its embossed design 18. After each playing marker is moved during the game, it is turned over. This allows the players to determine which marker must be moved at any time during the game. For example, when all of the markers on the board are turned over, this signifies that the first marker (circle) should be moved next. Other movement indicia may be used, including color, shape, and symbolic variations appropriately positioned on each marker.

The game is started with all playing markers removed from the playing field. A decision is made as to which player will move first. This could be accomplished by numerous methods, including the rolling of a die, or a coin flip. The players then take turns placing their markers on the field one at a time. Each marker is placed on an unoccupied square chosen electively by the player. The placement of markers occurs in the continuous, sequential order described above (circle first, ovoid second, etc.). Once each of the markers are on the board, the players continue to shift the position of their markers. During each turn, a player must move his appropriate marker to a new and unoccupied zone on the playing field. The position need not be adjacent to the previous position of the marker. The "jumping" of markers from one zone to a non-adjacent zone is permitted.

The moving of playing markers continues with the objective of a player occupying a diagonal, horizontal, or vertical row of zones on the field with his markers. When this occurs, a player is awarded a predetermined number of points. Play continues until one player reaches a selected maximum point total. It is not necessary to clear the board once a player has arranged his markers in a row.

In a preferred scoring mode, one point is awarded for each time a player occupies a row of zones with his playing markers. To keep track of each player's score, a plurality of scoring markers is provided, one for each player. A typical scoring marker 20, shown in FIG. 13, has a circular depression 22 with a diameter slightly larger than the diameter of the playing markers being used. When a player scores his first point, the first playing marker in his group is positioned in the depression 22 of the scoring marker 20, as shown in FIG. 14. In the embodiment of FIG. 1, the first playing marker would be either 12*a* or 14*a*. The playing marker/scoring marker combination is moved around the board until the next point is scored. The player then combines the scoring marker 20 with the second playing marker (12*b* or 14*b*) in the manner described above. This indicates that two points have been scored. For each player, the scoring marker 20 is moved from one playing marker to another until one player accumulates six points. By using the playing markers as described above, the score of each player can easily be recalled at any point during the game.

In addition, a weighted point system may be used in which the number of points awarded is based on numerous factors. For example, one point could be awarded for playing markers arranged in a horizontal row, two points for markers in a vertical row, and three points for the formation of a diagonal row. Point variations can be based on other factors, including the order of markers in the row. Furthermore, each move in the game may be timed, adding an additional dimension of skill.

To specifically demonstrate the method by which the present invention is played, a sequence of sample moves by two players is shown in FIGS. 3–12. The first player is using playing marker group 12, and the second player is using playing marker group 14. FIG. 3 shows the initial position of the markers after placement on the playing field, the positions having been chosen electively by the players. Zone and marker numbers referred to in FIGS. 3–12 are identical with those of FIG. 1. As noted above, each playing marker is normally turned over after a move is made. However, for the sake of clarity, this is not shown in FIGS. 3–12.

Figure 6:
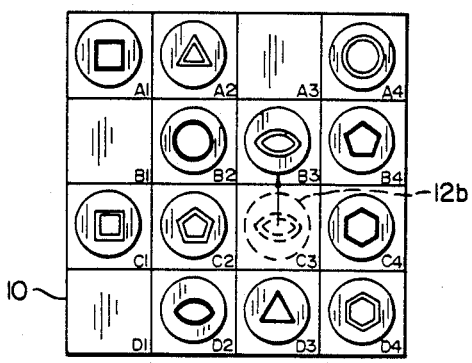
Figure 7:
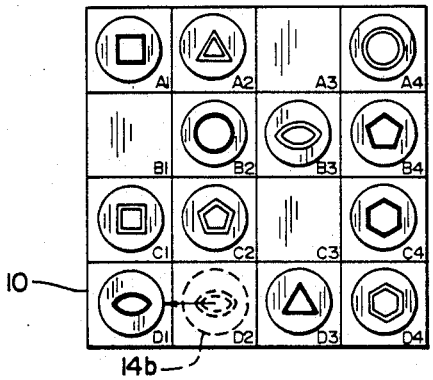

Starting with FIG. 4, player one moves marker 12*a* from zone B2 to zone A4 on playing field 10. Player two moves marker 14*a* from zone B1 to zone B2 (FIG. 5). In response, player one moves marker 12*b* from zone C3 to zone B3 (FIG. 6). Player two then moves marker 14*b* from zone D2 to zone D1 (FIG. 7). This move blocks a possible diagonal arrangement in zones A4, B3, C2, and D1 by player 1.

Figure 8:
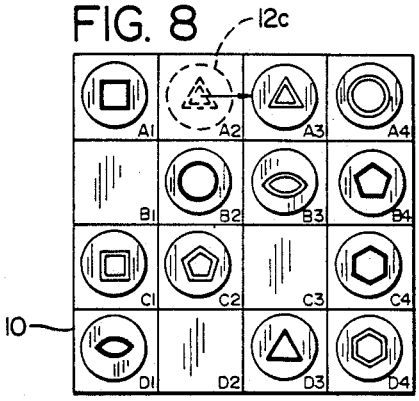
Figure 9:
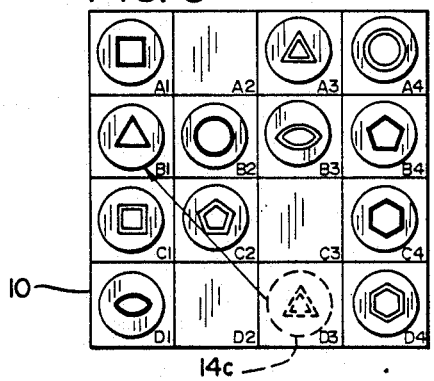
Figure 10:
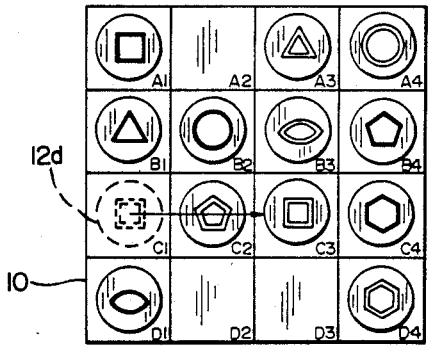
Figure 11:
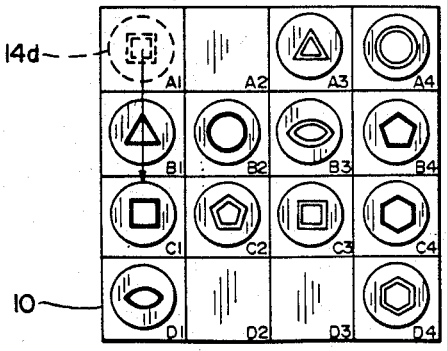
Figure 12:
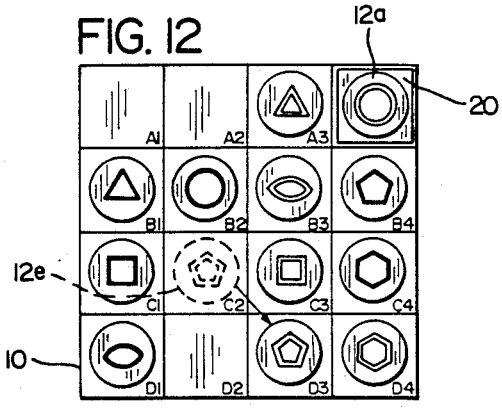

In FIG. 8, player one moves marker 12*c* from zone A2 to A3. Responding to this move, player two moves marker 14*c* from zone D3 to zone B1 (FIG. 9). Player one then counters by moving marker 12*d* from zone C1 to C3 (FIG. 10). In FIG. 11, player two responds by moving marker 14*d* from zone A1 to zone C1. Finally, capitalizing on an error of judgment by player two, player one scores by moving marker 12*e* from position C2 to D3, creating a vertical arrangement of zones A3, B3, C3, and D3 on the playing field as shown. A scoring marker 20 would then be placed on zone A4 with playing marker 12*a* being placed on top of scoring marker 20. This indicates that player one has scored one point. With the pieces in position as shown in FIG. 12, the game would continue, with player two moving marker 14*e* to an unoccupied zone on the playing field 10.

To play the game, as described herein, requires skill and tactical foresight. Aside from arranging markers in a line, a player must hinder his opponent from completing such an arrangement first. This is accomplished by selectively blocking the opponent's markers. In addition, the requirement that markers are moved in a continuous, sequential order increases the amount of skill necessary to defeat an opponent.

The foregoing is considered as illustrative only of the basic principles of the invention. Numerous elements of the above embodiment may be varied within the scope of the invention. Variations may occur involving the number of markers involved, the size, structure and arrangement of the playing field, the number of zones on the field, the system of awarding points to a winning player, and the types of memory indicia used. Furthermore, the present invention would include the above-described method of play in a computer software format. The basic steps involved in playing the game, as described above, would be translated into a machinereadable format. The playing field, playing markers, memory indicia, movement indicia and scoring markers would be projected on an appropriate display unit. Since numerous modifications and changes will readily occur to those skilled in the art, it is not desired to limit the invention to the exact construction and operation shown and described. Accordingly, all suitable modifications and equivalents may be resorted to, following within the scope of the invention as described in the following claims.

We claim:

1. A method of playing a game comprising:

(a) providing a playing field having a plurality of zones;

(b) providing at least two groups of playing markers, one group for each player, each marker of each group being distinguishable from the other markers in said group wherein each marker of each group comprises memory indicia thereon to mnemonically signify a continuous, sequential and unchanging order in which each of said markers of said group are moved during the playing of said game;

(c) selecting the order in which said players will commence play;

(d) each player on his first turn placing a mnemonically signifying first marker on an electively selected unoccupied zone on said playing field, said placing of said markers continuing thereafter wherein during each of the player's next successive turns, each player similarly places a next mnemonically signifying marker on said playing field according to said continuous, sequential order of (b); and (e) moving said markers after all of said markers are placed on the playing field, wherein during the next turn of each player, each player moves his mnemonically signifying first marker on said field to an unoccupied zone thereon, said moving of said markers continuing thereafter wherein during each of the players' next successive turns, each player similarly moves a next mnemonically signifying marker according to said continuous, sequential order of (b) with the objective of one of said players forming a continuous line of zones occupied by said markers of said player's group.

2. The method of claim 1 further comprising:

allocating a numerical score for each occurrence in which one of said players forms a continuous line of zones occupied by said markers of said player's group.

3. The method of claim 2 wherein said numerical score is one point.

4. The method of claim 3 wherein said moving of said markers on said field to unoccupied zones continues until one of said players accumulates six points.

5. The method of claim 1 further comprising:

limiting the amount of time allotted for each of said placing steps (d) and each of said moving steps of (e).

6. A method of playing a game comprising:

(a) providing a playing field having a plurality of zones;

(b) providing at least two groups of playing markers, one group for each player, each marker of each group being distinguishable from the other markers in said group wherein each marker of each group comprises memory indicia thereon to mnenemonically signify a continuous, sequential, and unchanging order in which each of said markers of said group are moved during the playing of said game;

(c) providing at least two scoring markers, one for each player;

(d) selecting the order in which said players will commence play;

(e) placing said markers from each of said groups each in an electively selected unoccupied zone on said playing field, one marker at a time, by each of said players in the selected order of (d), said placing of said markers being controlled by said continuous, sequential order of (b);

(f) moving said markers on said field to unoccupied zones thereon, one marker at a time by each of said players in the selected order of (d), said moving of said markers being controlled by said continuous, sequential order of (b) with the objective of one of said players forming a continuous line of zones occupied by said markers of said player's group;

(g) allocating a numerical score of one point for each occurrence in which one of said players forms a continuous line of zones occupied by said markers of said player's group;

(h) positioning a scoring marker adjacent a selected playing marker of said group used by a player scoring a point, said playing marker being selected based on the continuous sequential order of (b), starting with a mnemonically signifying first marker in said group, and positioning said scoring marker adjacent a next successive mnemonically signifying marker of said group when additional points are scored, moving from one playing marker to the next for each point scored; and (i) repeating steps (f), (g), and (h) until one of said players has accumulated six points.

* * * * *